US011400705B2

(12) United States Patent
Kubo

(10) Patent No.: US 11,400,705 B2
(45) Date of Patent: Aug. 2, 2022

(54) LIQUID EJECTION APPARATUS

(71) Applicant: Brother Kogyo Kabushiki Kaisha, Aichi-Ken (JP)

(72) Inventor: Isao Kubo, Tokoname (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/211,032

(22) Filed: Mar. 24, 2021

(65) Prior Publication Data

US 2021/0300030 A1 Sep. 30, 2021

(30) Foreign Application Priority Data

Mar. 26, 2020 (JP) ..... JP2020-056011

(51) Int. Cl.
*B41J 2/045* (2006.01)
*B41J 2/165* (2006.01)

(52) U.S. Cl.
CPC ..... *B41J 2/04555* (2013.01); *B41J 2/04586* (2013.01); *B41J 2/16535* (2013.01)

(58) Field of Classification Search
CPC ..... B41J 2/04555; B41J 2/04586; B41J 2/04581; B41J 2/16535; B41J 2/16508; B41J 2/16579; B41J 2/16517; B41J 2/0451; B41J 2/0452; B41J 2/14153; B41J 2/165; B41J 2/2139; B41J 2/2142; B41J 2/2146; B41J 2002/1657; B41J 2002/16573
See application file for complete search history.

(56) References Cited

U.S. PATENT DOCUMENTS 7,673,956 B2 3/2010 Izuo
9,533,496 B2 1/2017 Takeuchi et al.
2007/0134969 A1* 6/2007 Endo ..... B41J 2/16579 439/341
2007/0188538 A1* 8/2007 Izuo ..... B41J 25/308 347/19

(Continued)

FOREIGN PATENT DOCUMENTS

JP 2007-098642 A 4/2007
JP 2007-112086 A 5/2007

(Continued)

*Primary Examiner* — Kristal Feggins
(74) *Attorney, Agent, or Firm* — Banner & Witcoff, Ltd.

(57) ABSTRACT

In a liquid ejection apparatus, a controller of the liquid ejection apparatus is configured to, in response to receiving a recording instruction to instruct the liquid ejection apparatus to perform image recording on a recording medium, perform ejection inspection to determine whether liquid is ejected from each nozzle of a liquid ejection head toward an electrode based on a signal outputted from a signal output circuit. For the ejection inspection, the controller is configured to control a voltage applying circuit to apply an inspection voltage between the electrode and the liquid ejection head. In response to detecting that a leakage current greater than a predetermined value flows between the electrode and the liquid ejection head, the controller is configured to cancel the ejection inspection and control a voltage applying circuit to apply a reverse voltage opposite in polarity to the inspection voltage between the electrode and the liquid ejection head.

9 Claims, 9 Drawing Sheets

(56) References Cited

U.S. PATENT DOCUMENTS

| | | | | |
|---|---|---|---|---|
| 2010/0060690 | A1* | 3/2010 | Hosokawa | B41J 2/0451 347/14 |
| 2013/0120495 | A1 | 5/2013 | Nakamura et al. | |
| 2013/0120496 | A1 | 5/2013 | Nakamura et al. | |
| 2016/0257113 | A1 | 9/2016 | Takeuchi et al. | |

FOREIGN PATENT DOCUMENTS

| | | | |
|---|---|---|---|
| JP | 2007-136857 | A | 6/2007 |
| JP | 2011-000798 | A | 1/2011 |
| JP | 2013-103376 | A | 5/2013 |
| JP | 2016-159503 | A | 9/2016 |

* cited by examiner

LIQUID EJECTION APPARATUS

CROSS-REFERENCE TO RELATED APPLICATION

This application claims priority from Japanese Patent Application No. 2020-056011 filed on Mar. 26, 2020, the content of which is incorporated herein by reference in its entirety.

BACKGROUND

Examples of a liquid ejection apparatus that ejects liquid from nozzles include an inkjet recording apparatus that ejects ink from nozzles. A known inkjet recording apparatus includes a capping member having an opening edge defining an opening. The capping member is to cover the nozzles with the opening edge in contact a surface having the nozzles (e.g., a nozzle plate). The capping member accommodates an electrode. Inspection of whether ink is ejected from the nozzles is performed with the opening edge of the capping member spaced from the nozzle plate of a print head. In the inspection, the print head is moved to eject ink from the nozzles toward the electrode to which voltage is applied (or toward an inspection area). This prevents deposits of ink accumulating in the inspection area from contacting the nozzle plate, lowering the possibility that a leakage current flows between the electrode and the print head.

SUMMARY

According to one or more aspects of the disclosure, a liquid ejection apparatus includes a liquid ejection head having an array of nozzles, a cap configured to cover the nozzles, an electrode accommodated in the cap, a voltage applying circuit, a signal output circuit connected to the electrode, and a controller. The liquid ejection head is configured to eject liquid from each of the nozzles. The voltage applying circuit configured to apply a voltage between the electrode and the liquid ejection head. The controller is configured to, in response to receiving a recording instruction to instruct the liquid ejection apparatus to perform image recording on a recording medium, perform ejection inspection to determine whether liquid is ejected from each nozzle toward the electrode based on a signal outputted from the signal output circuit. To perform the ejection inspection, the controller is configured to cause the liquid ejection head and the cap to face each other, control the voltage applying circuit to apply an inspection voltage between the electrode and the liquid ejection head with the liquid ejection head and the cap facing each other, and drive the liquid ejection head to eject liquid from a nozzle of the nozzles toward the electrode. During the ejection inspection, the controller is configured to detect whether a leakage current greater than a predetermined value flows between the electrode and the liquid ejection head based on a signal from the signal output circuit. In response to detecting that a leakage current greater than the predetermined value flows between the electrode and the liquid ejection head, the controller is configured to cancel the ejection inspection and control the voltage applying circuit to apply a reverse voltage opposite in polarity to the inspection voltage between the electrode and the liquid ejection head.

According to the one or more aspects of the disclosure, if a leakage current greater than the predetermined value flows between the electrode and the liquid ejection head during ejection inspection, the ejection inspection is suspended, and a reverse voltage opposite in polarity to the inspection voltage is applied therebetween. The electric charge accumulated in the inkjet head can be thus discharged therefrom in response to the leakage current flowing. This enables the ejection inspection under a state that the nozzles are brought as close to the cap as possible.

DETAILED DESCRIPTION

In the above-described known inkjet recording apparatus, during the nozzle inspection, the capping member and the nozzle plate are spaced to prevent a leakage current from flowing. However, a small distance between the capping member and the nozzle plate may cause a leakage current to flow via ink adhering to the opening edge of the capping member and other objects. In contrast, a large distance between the capping member and the nozzle plate may reduce the strength of a signal to be outputted when ink is ejected from a nozzle toward the electrode for inspection.

Aspects of the disclosure provide a liquid ejection apparatus configured to output a signal with adequate strength when ink is ejected from a nozzle of a liquid ejection head toward an electrode in a cap to which voltage is applied, based on the presumption that a leakage current flows between the liquid ejection head and the electrode.

Hereinafter, an illustrative embodiment will be described with reference to the accompanying drawings.

General Configuration of Printer

Figure 1:
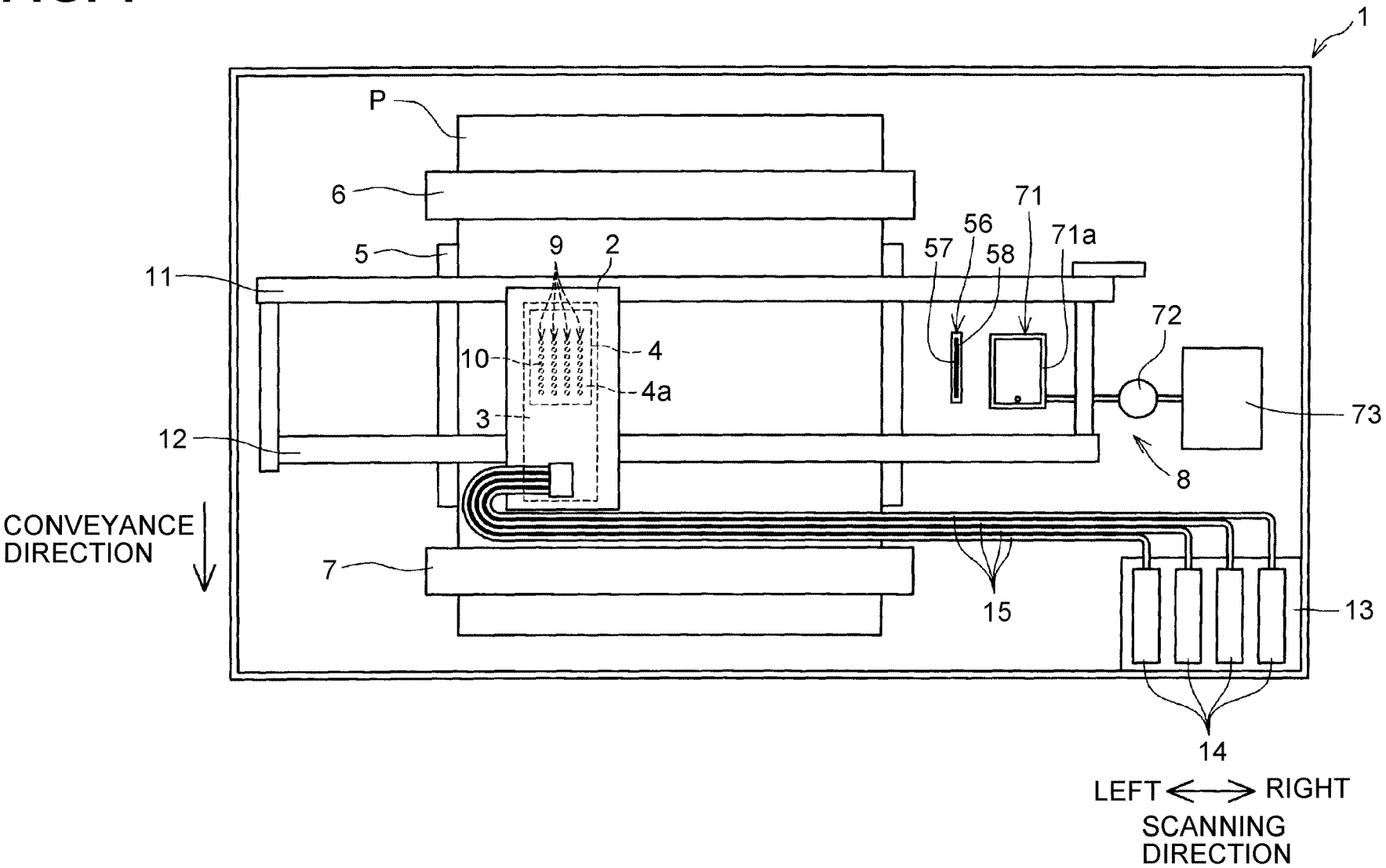
FIG. 1 is a schematic diagram illustrating a general configuration of a printer according to an illustrative embodiment of the disclosure.

As illustrated in FIG. 1, a printer 1 (as an example of a liquid ejection apparatus) includes a carriage 2, a subtank 3, an inkjet head 4 (as an example of a liquid ejection head), a platen 5, conveyance rollers 6 and 7, and a maintenance unit 8.

The carriage 2 is supported by two guide rails 11 and 12 each extending in a scanning direction (e.g., a right-left direction). The carriage 2 is configured to reciprocate in the scanning direction along the guide rails 11 and 12. The carriage 2 is connected to a carriage motor 86 (in FIG. 6) via a belt. In response to driving of the carriage motor 86, the carriage 2 moves in the scanning direction along the guide rails 11 and 12. The scanning direction corresponds to a right-left direction as illustrated in FIG. 1.

The subtank 3 is mounted on the carriage 2. The printer 1 further includes a cartridge holder 13. The cartridge holder 13 accommodates a plurality of, for example, four, ink cartridges 14 that are detachable. The four ink cartridges 14 arranged in the scanning direction store ink (as an example of liquid) of different colors, from right to left, black, yellow, cyan, and magenta, respectively. The subtank 3 is connected via four tubes 15 to the four ink cartridges 14 attached to the cartridge holder 13. Such a configuration thus enables supply of ink of the four colors to the subtank 3 from the four ink cartridges 14. The cartridge holder 13 includes cartridge sensors 16 (in FIG. 6) for the respective ink cartridges 14. The cartridge sensors 16 are each configured to output a signal corresponding to whether a corresponding ink cartridge 14 is attached to the cartridge holder 13.

The inkjet head 4 is mounted on the carriage 2 and connected to a lower end of the subtank 3. The inkjet head 4 is supplied with ink of the four colors from the subtank 3.

The inkjet head 4 has an array of nozzles 10 defined in a nozzle surface 4*a* that is its lower surface. The inkjet head 4 is configured to eject ink from the nozzles 10. Specifically, for example, the nozzles 10 are arranged in rows extending in a conveyance direction orthogonal to the scanning direction to form nozzle rows 9. The inkjet head 4 includes a plurality of, for example, four, nozzle rows 9 next to each other in the scanning direction. In the inkjet head 4, black ink is ejected from the nozzles 10 constituting the rightmost nozzle row 9 in the scanning direction. Yellow ink is ejected from the nozzles 10 constituting the nozzle row 9 to the left of the black nozzle row 9. Cyan ink is ejected from the nozzles 10 constituting the nozzle row 9 to the left of the yellow nozzle row 9. Magenta ink is ejected from the nozzles 10 constituting the nozzle row 9 to the left of the cyan nozzle row 9.

The platen 5 is disposed below the inkjet head 4 and faces the nozzles 10. The platen 5 extends in the scanning direction to have a dimension covering the entire width of a recording sheet P (as an example of a recording medium) to be conveyed. The platen 5 is configured to support from below a recording sheet P being conveyed. The conveyance roller 6 is disposed upstream of the inkjet head 4 and the platen 5 in the conveyance direction. The conveyance roller 7 is disposed downstream of the inkjet head 4 and the platen 5 in the conveyance direction. The conveyance rollers 6 and 7 are connected to a conveyance motor 87 (in FIG. 6) via gears. In response to driving of the conveyance motor 87, the conveyance rollers 6 and 7 rotate to convey a recording sheet P in the conveyance direction.

The maintenance unit 8 includes a cap 71, a suction pump 72, a waste liquid tank 73, and a wiper 56. The cap 71 is disposed to the right of the platen 5 in the scanning direction. The cap 71 has a rectangular planar shape. The cap 71 has a lip portion 71*a* protruding upward or toward the inkjet head 4 around an outer edge of the cap 71. When the carriage 2 is located in a maintenance position, the nozzles 10 face the cap 71. The maintenance position is further to the right than the platen 5 in the scanning direction.

Figure 6:
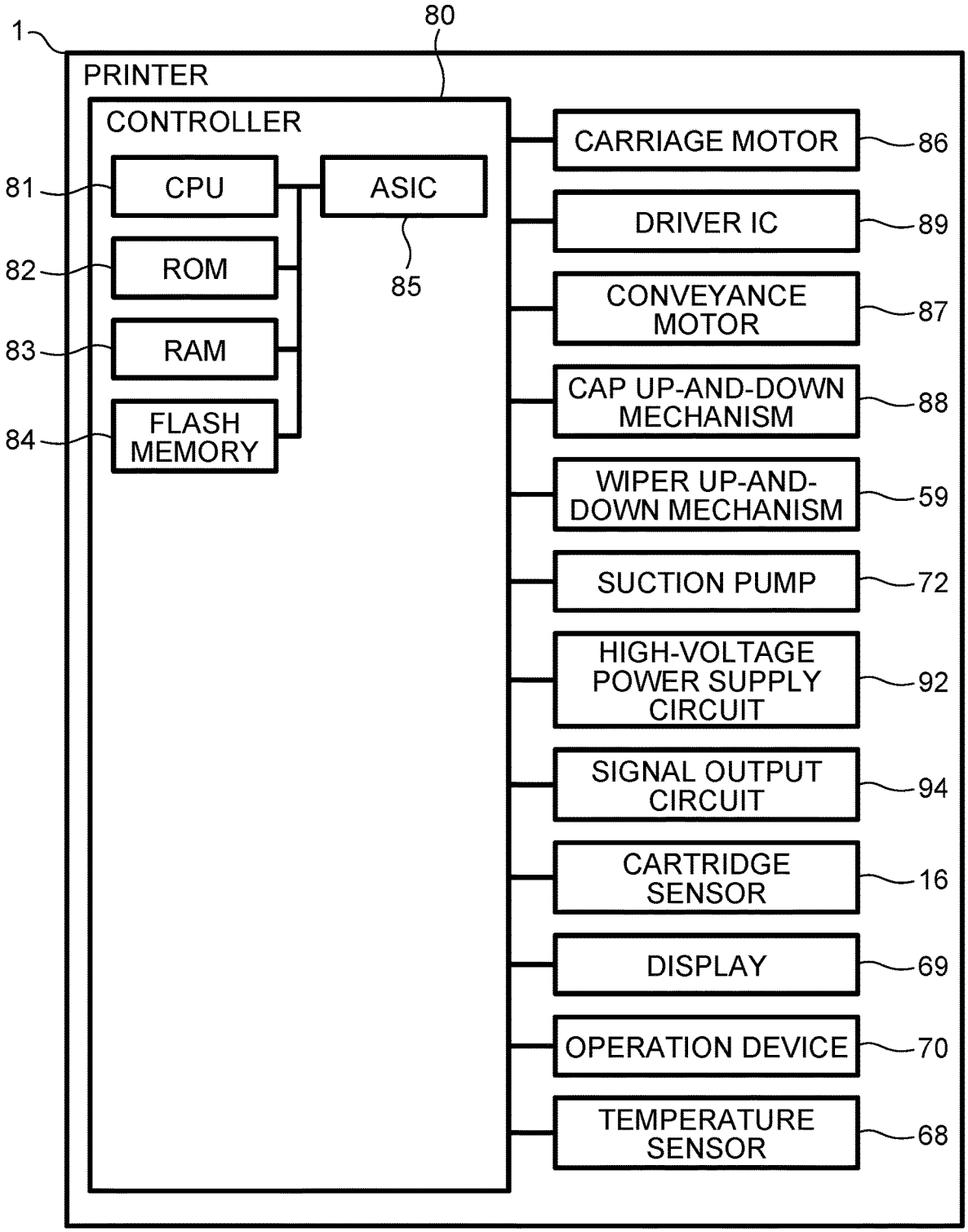
FIG. 6 is a block diagram illustrating an electrical configuration of the printer.

The cap 71 is movable upward and downward selectively by control of a cap up-and-down mechanism 88 (in FIG. 6). The carriage 2 is moved to stop at the maintenance position so that the nozzles 10 and the cap 71 face each other. In such a state, in response to the cap 71 being moved upward by the cap up-and-down mechanism 88, the lip portion 71*a* of the cap 71 intimately contacts the nozzle surface 4*a* of the inkjet head 4 to cover the nozzles 10. At this time, the cap 71 that covers the nozzles 10 is in a capping state, and the nozzles 10 capped by the cap 71 are in a capped state. The cap 71 is not limited to have such a configuration that the lip portion 71*a* intimately contacts the nozzle surface 4*a* to cover the nozzles 10. The cap 71 may be structured such that that the lip portion 71*a* intimately contacts a frame surrounding the nozzle surface 4*a* of the inkjet head 4 to cover the nozzles 10.

The suction pump 72 may be a tube pump. The suction pump 72 is connected to the cap 71 and the waste liquid tank 73. The maintenance unit 8 use the suction pump 72 to perform suction purge in which, in response to driving of the suction pump 72 in a state where the nozzles 10 are in the capped state, ink in the inkjet head 4 is pumped out or discharged from the nozzles 10. The suction purge is an example of a discharging operation. Ink discharged from the inkjet head 4 by the suction purge is collected in the waste liquid tank 73.

For the sake of convenience, in this embodiment, the cap 71 covers all the nozzles 10 of the inkjet head 4 and the suction purge is performed to discharge ink in the inkjet head 4 from all the nozzles 10. In some embodiments, the maintenance unit 8 may include a plurality of caps 71, one for covering the nozzles 10 constituting the rightmost nozzle row 9 from which black ink is discharged, and the other for covering the nozzles 10 constituting the remaining three nozzle rows 9 from which respective color inks (e.g., yellow, cyan, and magenta inks) are discharged. Such a configuration may enable the suction purge to discharge black ink or color inks selectively in the inkjet head 4. Alternatively, for example, the maintenance unit 8 may include a plurality of caps 71 for respective nozzle rows 9. Such a configuration may enable ink to be discharged from the nozzles 10 of the inkjet head 4 on a nozzle row 9 basis.

Figure 2:
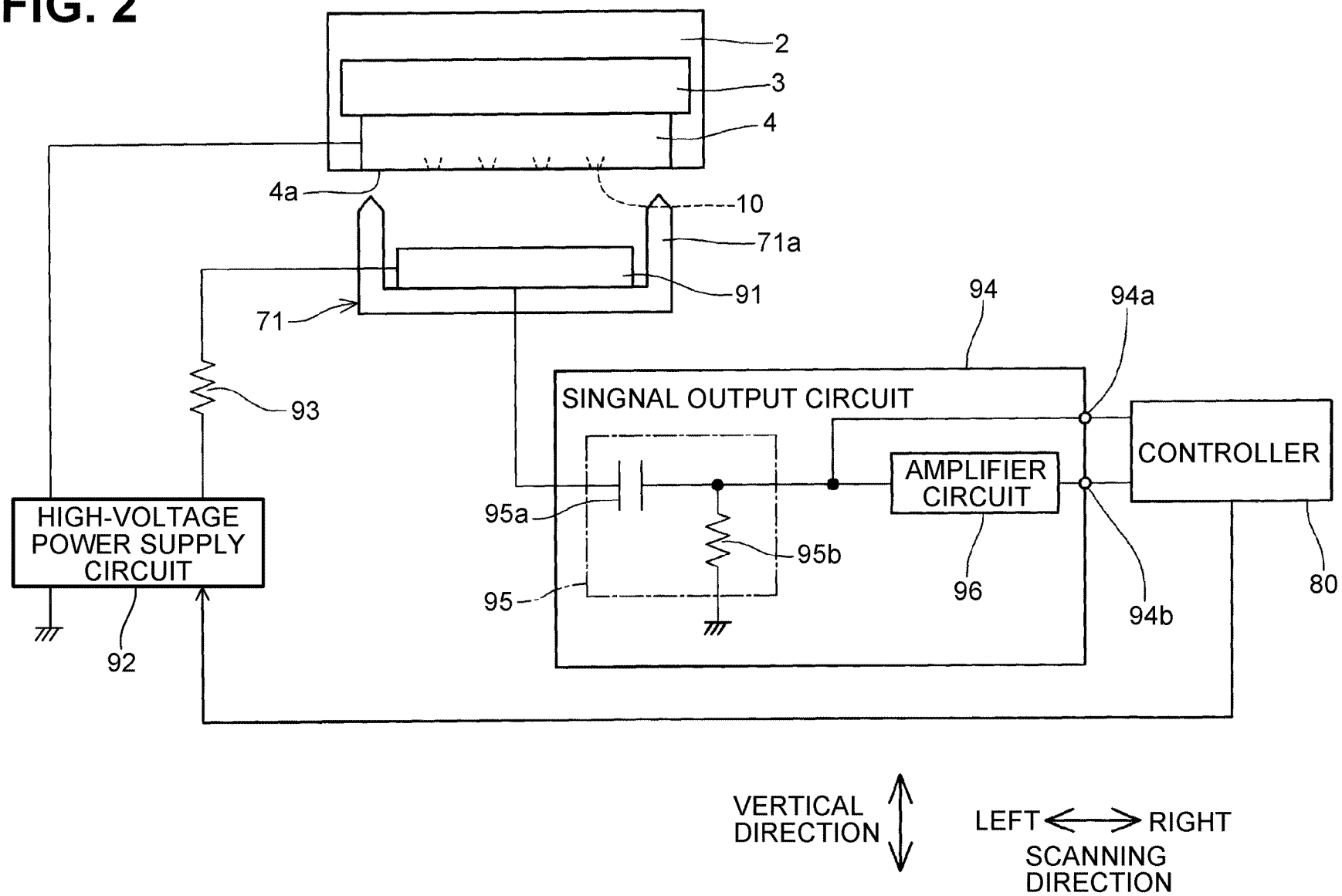
FIG. 2 illustrates a detection electrode disposed in a cap, a connection relationship between the detection electrode and a high-voltage power supply circuit, and a connection relationship between the detection electrode and a determination circuit.

As illustrated in FIG. 2, a detection electrode 91 having a rectangular planar shape is disposed within the cap 71. The detection electrode 91 is connected to a high-voltage power supply circuit 92 (as an example of a voltage applying circuit) via a resistor 93. The high-voltage power supply circuit 92 is connected to a conductive portion of the inkjet head 4. The conductive portion is defined by plates 32 to 35 of the inkjet head 4 that are made of a conductive material. The conductive portion of the inkjet head 4 is connected to a ground terminal of the high-voltage power supply circuit 92, and maintained at ground potential. The detection electrode 91 receives an electric potential or a voltage from the high-voltage power supply circuit 92. Thus, the high-voltage power supply circuit 92 applies voltage between the detection electrode 91 and the conductive portion of the inkjet head 4.

The detection electrode 91 is connected to a signal output circuit 94. The signal output circuit 94 includes a filter circuit 95 and an amplifier circuit 96. The filter circuit 95 is connected to the detection electrode 91. The filter circuit 95 has a capacitor 95*a* and a resistor 95*b*, and removes a high-voltage DC component from the potential of the detection electrode 91 applied by the high-voltage power supply circuit 92. A signal corresponding to which the filter circuit 95 has removed the high-voltage DC component from the potential of the detection electrode 91 is outputted from an output 94*a* of the signal output circuit 94.

The filter circuit 95 is connected to the amplifier circuit 96. The amplifier circuit 96 amplifies the signal of which the filter circuit 95 has removed the high-voltage DC component from the potential of the detection electrode 91. The signal amplified by the amplifier circuit 96 is outputted from an output 94*b* of the signal output circuit 94.

In an ejection inspection described later in this embodiment, the high-voltage power supply circuit 92 applies the inspection voltage (e.g., approximately 300 v) between the detection electrode 91 and the conductive portion of the inkjet head 4 by maintaining the conductive portion at the ground potential, applying a predetermined positive potential (e.g., approximately 300 v) to the detection electrode 91, and setting the nozzles 10 in the capped state, in order to drive the inkjet head 4 to eject ink droplets from the nozzles 10 in the capped state.

In a case where ink is ejected from a nozzle 10, ink becomes electrically charged by the potential difference between the detection electrode 91 and the conductive portion of the inkjet head 4. Until the charged ink approaches and reaches the detection electrode 91, the potential of the detection electrode 91 rises from a potential at which the inkjet head 4 is not driven. After the charged ink reaches the detection electrode 91, the potential of the detection electrode 91 gradually lowers to the potential thereof at which the inkjet head 4 is not driven. In other words, the potential of the detection electrode 91 changes in a driving period Td during which the inkjet head 4 is driven.

Figure 3A:
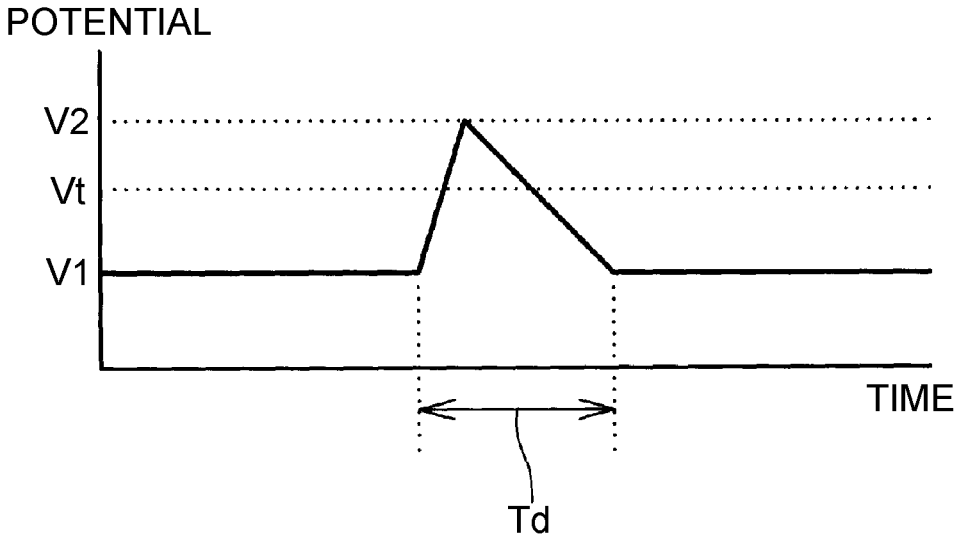
FIG. 3A is a graph showing changes in potential of the detection electrode in a case where ink has been ejected from a nozzle.

However, the change in the potential of the detection electrode 91 is not so large at this time. As described above, the signal output circuit 94 is structured such that the potential of the detection electrode 91 from which the high-voltage DC component has been removed at the filter circuit 95 is amplified at the amplifier circuit 96 and then outputted from the output 94*b*. As illustrated in FIG. 3A, in the driving period Td of the inkjet head 4, the potential outputted from the output 94*b* rises from a potential V1 at which the inkjet head 4 is not driven, reaches a potential V2, which is higher than the potential V1, and gradually lowers to the potential V1.

Figure 3B:
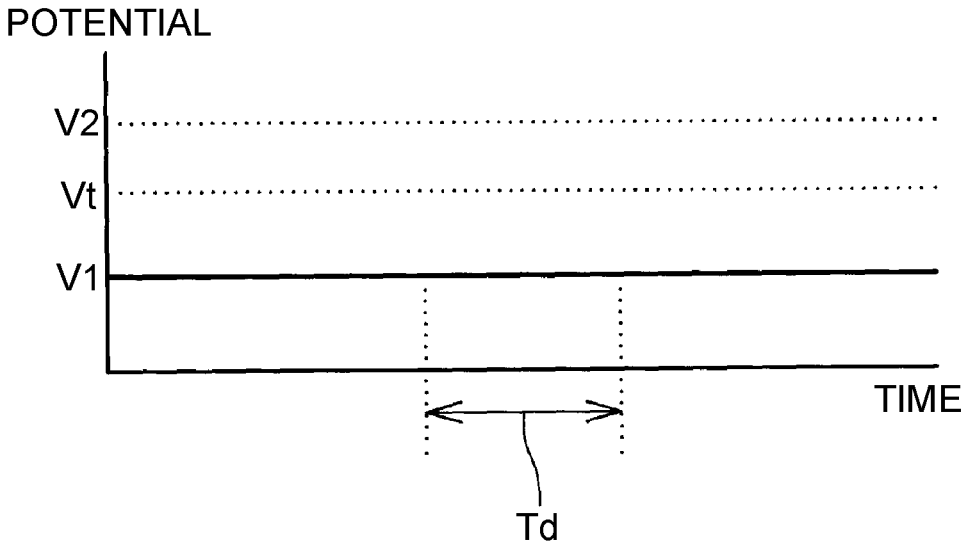
FIG. 3B is a graph showing no change in potential of the detection electrode in a case where ink has not been ejected from a nozzle.

In contrast, in a case where ink is not ejected from a nozzle 10 while the inkjet head 4 is driven, the potential of the detection electrode 91 hardly changes from the potential at which the inkjet head 4 is not driven in the driving period Td of the inkjet head 4. Thus, as illustrated in FIG. 3B, the potential outputted from the output 94*b* hardly changes from the potential V1 in the driving period Td of the inkjet head 4.

The signal output circuit 94 thus outputs, from the output 94*b*, a signal responsive to whether a nozzle 10 is a failure nozzle that does not eject ink. As illustrated in FIG. 3A, a threshold value Vt satisfying an equation $V1<Vt<V2$ is specified to determine whether a nozzle 10 is a failure nozzle based on whether a maximum potential outputted from the output 94*b* exceeds the threshold value Vt in the driving period Td of the inkjet head 4.

As described above, when the high-voltage power supply circuit 92 applies the inspection voltage for between the detection electrode 91 and the conductive portion of the inkjet head 4 and the inkjet head 4 is driven to eject ink from the nozzles 10 in the capped state, a leakage current greater than a predetermined value may flow between the detection electrode 91 and the inkjet head 4, for example, via ink adhering to the lip portion 71*a* of the cap 71. In the following, "a leakage current greater than a predetermined value flows" may refer to "a leakage occurs".

When a leakage occurs, the potential of the detection electrode 91 changes. The change in the potential of the detection electrode 91 is much larger at the leakage than at which ink is ejected from the nozzle 10 to the detection electrode 91.

Thus, the signal output circuit 94 is structured such that the potential of the detection electrode 91 from which the high-voltage DC component has been removed at the filter circuit 95 is outputted from the output 94*a* without being amplified at the amplifier circuit 96. The signal output circuit 94 thus outputs, from the output 94*a*, a signal responsive to whether a leakage has occurred. The value of the signal varies responsively to the magnitude of the leakage current.

In this embodiment, the high-voltage power supply circuit 92 applies the inspection voltage between the detection electrode 91 and the conductive portion of the inkjet head 4 by maintaining the conductive portion at the ground potential and applying the predetermined positive potential to the detection electrode 91. However, the high-voltage power supply circuit 92 may apply an inspection voltage between the detection electrode 91 and the conductive portion of the inkjet head 4 by maintaining the conductive portion at the ground potential and applying a predetermined negative potential (e.g., approximately −300 v) to the detection electrode 91. In this case, the rising and dropping of the potential outputted from the outputs 94*a* and 94*b* becomes opposite to that described above.

Alternatively, the high-voltage power supply circuit 92 may apply an inspection voltage between the detection electrode 91 and the conductive portion of the inkjet head 4 by applying a potential other than the ground potential to the conductive portion and applying a different potential to the detection electrode 91. In this case, when the high-voltage power supply circuit 92 applies, to the detection electrode 91, a potential higher than that of the conductive portion of the inkjet head 4, the rising and dropping of the potential of the detection electrode 91 at which ink is ejected from the nozzle 10 becomes similar to that illustrated in FIG. 3A. When the high-voltage power supply circuit 92 applies, to the detection electrode 91, a potential lower than that of the conductive portion of the inkjet head 4, the rising and dropping of the potential of the detection electrode 91 at which ink is ejected from the nozzle 10 becomes opposite to that illustrated in FIG. 3A.

The wiper 56 is located between the platen 5 and the cap 71 in the scanning direction. The wiper 56 includes a wiper blade 57 and a support member 58. The wiper blade 57 is made of an elastic material such as rubber, and is a thin plate-shaped member extending in the vertical direction and in the conveyance direction. The support member 58 supports a lower end of the wiper blade 57.

The support member 58 is movable upward and downward together with the wiper blade 57 by control of a wiper up-and-down mechanism 59. When the support member 58 is lowered by the wiper up-and-down mechanism 59, an upper end of the wiper blade 57 is located below the nozzle face 4*a*. When the support member 58 is raised by the wiper up-and-down mechanism 59, the upper end of the wiper blade 57 is located above the nozzle face 4*a*. In a case where the wiper 56 is kept raised, the carriage 2 is moved in the scanning direction in a region where the nozzle face 4*a* and the wiper 56 face each other. During the movement of the carriage 2, the nozzle surface 4*a* and the wiper blade 57 move relative to each other in the scanning direction while the wiper blade 57 contacts the nozzle surface 4*a* with the upper end of the wiper blade 57 being elastically deformed. This is wiping in which the wiper blade 57 wipes ink adhering to the nozzle surface 4*a*.

The wiper 56 is not limited to the above configuration of wiping ink adhering to the nozzle surface 4*a* by the wiper blade 57 that is thin plate shaped. For example, a wiping member wound around a roller as disclosed in Japanese Patent No. 5899840 may be used. During the movement of the carriage 2, the nozzle surface 4*a* and the wiping member may relatively move in contact with each other such that the wiping member can wipe ink adhering to the nozzle surface 4*a*.

Inkjet Head

Figure 4:
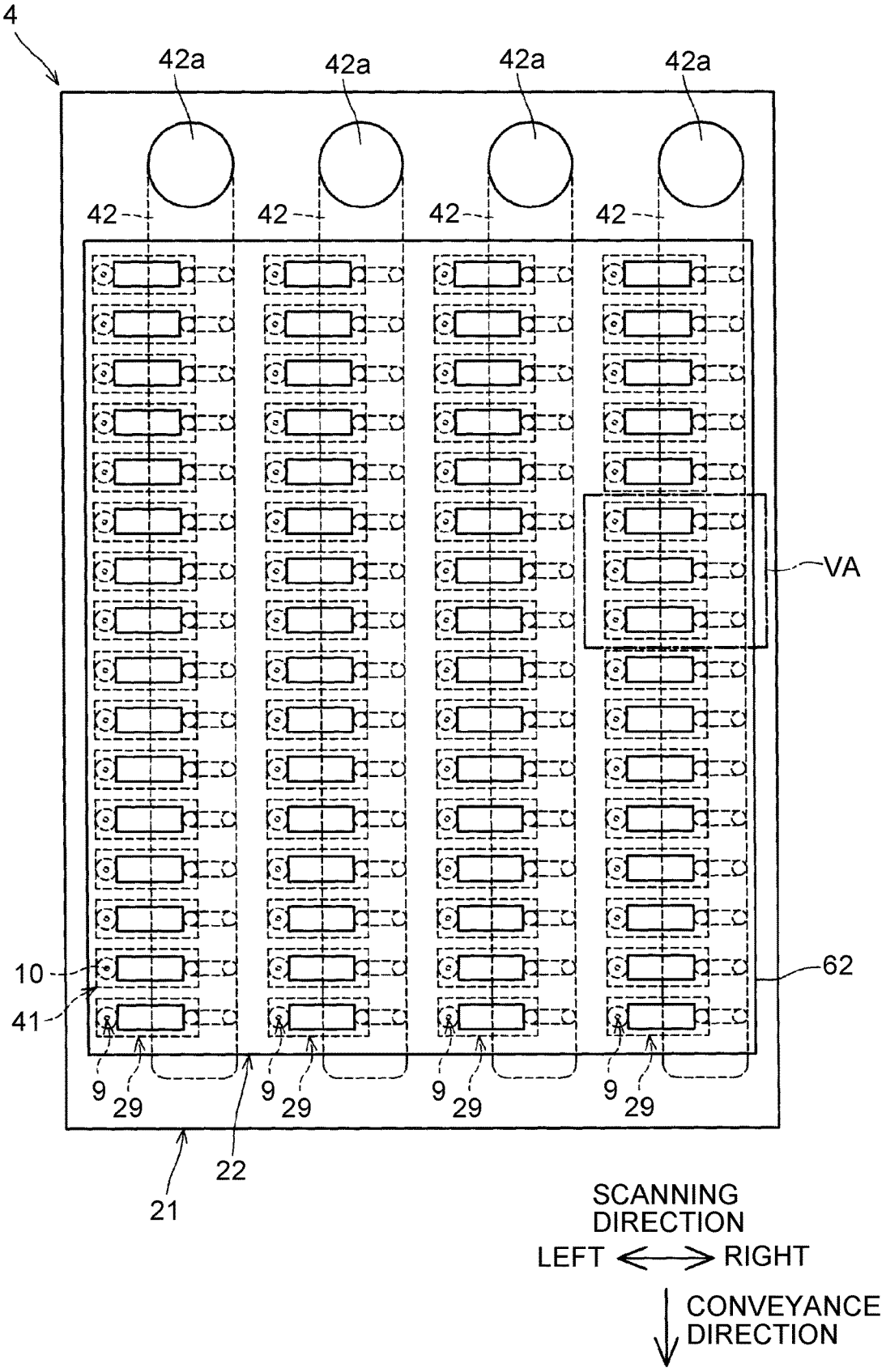
FIG. 4 is a plan view of the inkjet head of FIG. 1.
Figure 5A:
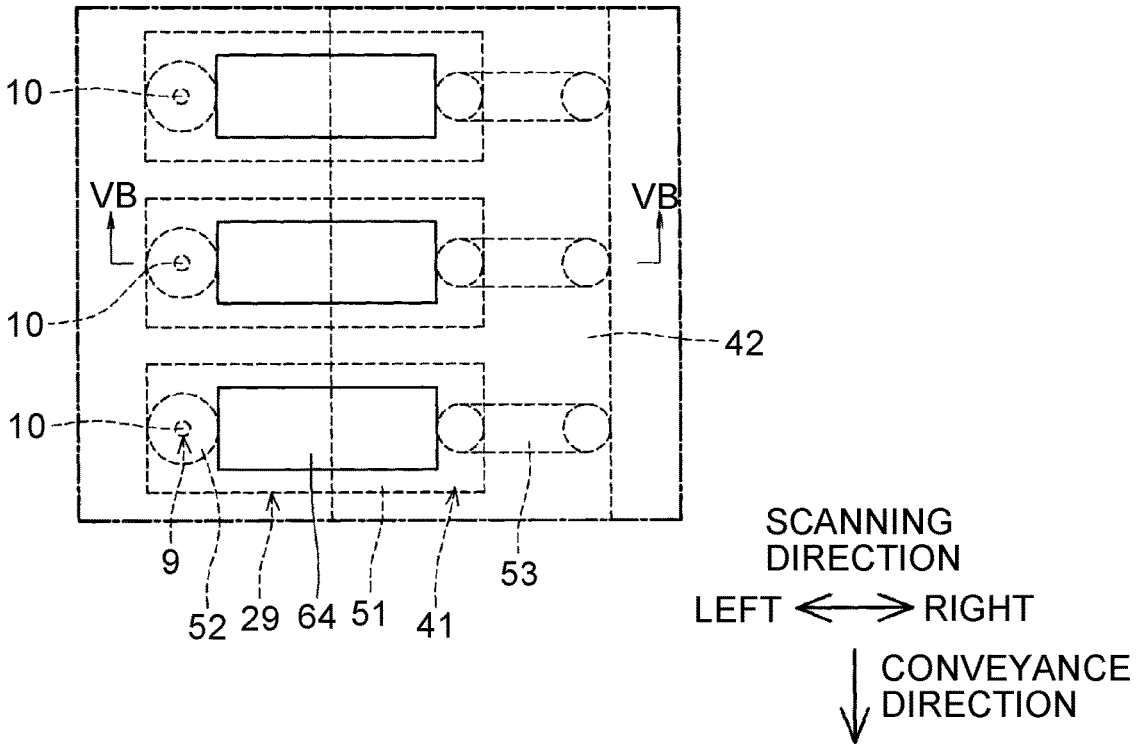
FIG. 5A is an enlarged view of a VA section of the inkjet head in FIG. 4.
Figure 5B:
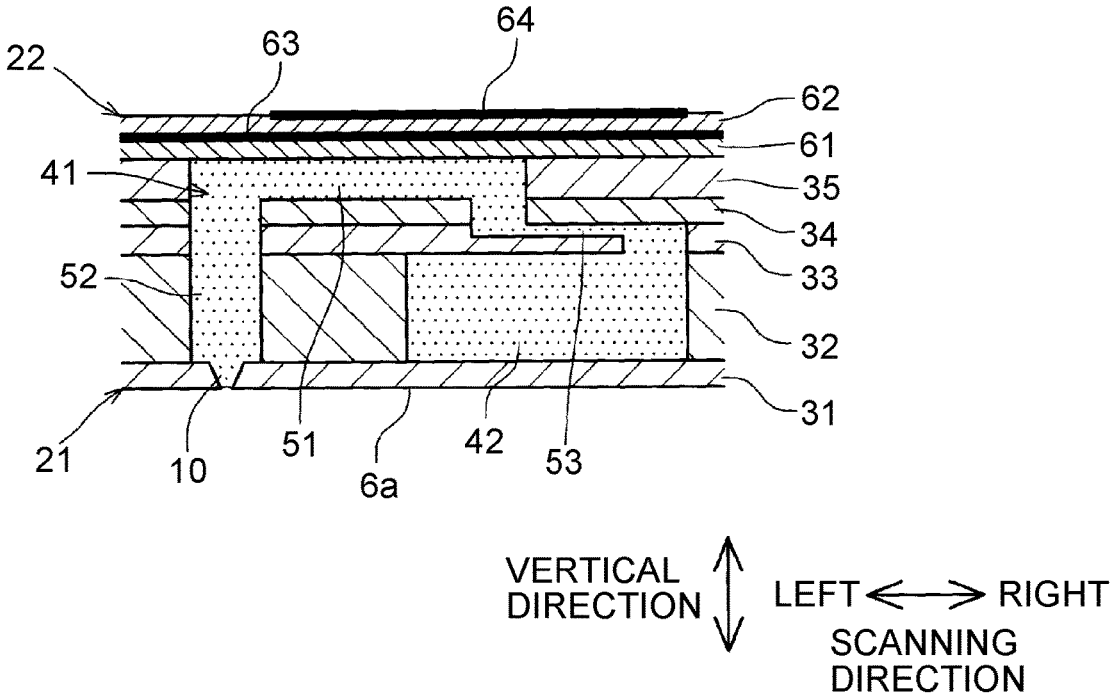
FIG. 5B is a cross-sectional view of the inkjet head taken along a VB-VB line of FIG. 5A.

A detailed configuration of the inkjet head 4 will be described. As illustrated in FIGS. 4, 5A, and 5B, the inkjet head 4 has a channel unit 21 and a piezoelectric actuator 22.

The channel unit 21 includes a plurality of, for example, five plates 31, 32, 33, 34, and 35 stacked on one above another in this order from below in the vertical direction. The plate 31 is made of a synthetic resin material. The plates 32 to 35 are made of a conductive material such as metal. The stacked plates 31 to 35 are bonded, for example, by a thermosetting adhesive.

The channel unit 21 includes a plurality of individual channels 41 and four common channels 42. As with the nozzles 10 arranged in the four nozzle rows 9 as described above, the individual channels 41 are arranged in four individual-channel rows 29 each extending in the conveyance direction. The channel unit 21 has the four individual-channel rows 29 next to each other in the scanning direction.

Each individual channel 41 includes a nozzle 10, a pressure chamber 51, a descending channel 52, and a narrowed channel 53. The pressure chamber 51 has a left end in the scanning direction connected to the nozzle 10 via the descending channel 52, and a right end connected to the narrowed channel 53. The nozzle 10, the pressure chamber 51, the descending channel 52, and the narrowed channel 53 are similar in structure and positional relationship to those known in the art. Thus, further detailed description thereof will be omitted.

The four common channels 42 correspond to the four individual-channel rows 29. Each common channel 42 extends in the conveyance direction, and overlaps right portions of individual channels 41 in a corresponding individual-channel row 29 in the vertical direction. Each common channel 42 is connected to right ends of the narrowed channels 53 constituting the individual channels 41. Each common channel 42 has a supply port 42*a* at its upstream end in the conveyance direction. Ink is to be supplied from the supply port 42*a*.

The piezoelectric actuator 22 has a vibrating plate 61, a piezoelectric layer 62, a common electrode 63, and a plurality of individual electrodes 64. The vibrating plate 61 is made of a piezoelectric material having, as a main ingredient, lead zirconate titanate, which is a mixed crystal of lead titanate and lead zirconate. The vibrating plate 61 is disposed on an upper surface of the channel unit 21 (i.e., an upper surface of the plate 35) and covers the pressure chambers 51. The piezoelectric layer 62 is made of the piezoelectric material described above. The piezoelectric layer 62 is disposed on an upper surface of the vibrating plate 61 and extends continuously over the pressure chambers 51. In this embodiment, the vibrating plate 61 and the piezoelectric layer 62 are made of the piezoelectric material. The vibrating plate 61, however, may be made of an insulating material other than a piezoelectric material, for example, a synthetic resin material.

The common electrode 63 is disposed between the vibrating plate 61 and the piezoelectric layer 62, and extends over their entire surfaces. The common electrode 63 is connected to a power supply via a wire and maintained at the ground potential. The individual electrodes 64 are disposed on an upper surface of the piezoelectric layer 62. Each individual electrode 64 is provided for a corresponding pressure chamber 51 and vertically overlaps a central portion of the corresponding pressure chamber 51 in the vertical direction. Each individual electrode 64 is connected to a driver IC 89 (in FIG. 6) via a corresponding wire. Each individual electrode 64 receives the ground potential or a predetermined drive potential (e.g., approximately 20 v) selectively from the driver IC 89. As the common electrode 63 and the individual electrodes 64 are disposed as described above, the piezoelectric layer 62 is polarized at portions sandwiched between the common electrode 63 and the individual electrodes 64 in its thickness direction.

The piezoelectric actuator 22 changes a potential difference between the common electrode 63 and each individual electrode 64 carrying a potential supplied from the driver IC 89 to deform the piezoelectric layer 62 and portions of the vibrating plate 61 overlapping with the pressure chambers 51 in the vertical direction. This fluctuates ink pressure in the pressure chambers 51, thus enabling the nozzles 10 communicating with the pressure chambers 51 to eject ink.

Electrical Configuration of Printer

Hereinafter, a description will be provided on an electrical configuration of the printer 1. As illustrated in FIG. 6, the printer 1 includes a controller 80 that controls operation of the printer 1. The controller 80 includes a CPU 81, a ROM 82, a RAM 83, a flash memory 84, and an ASIC 85. The controller 80 controls the carriage motor 86, the driver IC 89, the conveyance motor 87, the cap up-and-down mechanism 88, the suction pump 72, the high-voltage power supply circuit 92, and the wiper up-and-down mechanism 59. In this embodiment, the controller 80 controls the inkjet head 4 by controlling the driver IC 89.

The controller 80 receives a signal responsive to whether a nozzle is a failure nozzle, from the output 94*b* of the signal output circuit 94. The controller 80 receives a signal responsive to whether a leakage has occurred, from the output 94*a* of the signal output circuit 94. The controller 80 receives a signal responsive to whether the ink cartridges 14 are attached to the cartridge holder 13, from the cartridge sensors 16.

The printer 1 includes a display 69, an operation device 70, and a temperature sensor 68. The display 69 may include a liquid crystal display. The controller 80 controls the display 69 to display information and messages related to the operations of the printer 1. The operation device 70 includes buttons provided on the printer 1 and a touch screen provided on the display 69. In response to the user operating the operation device 70, the controller 80 receives a signal responsive to the operation. The temperature sensor 68 is used for detecting a temperature of the printer 1. The controller 80 receives a signal corresponding to the detected temperature from the temperature sensor 68.

In the controller 80, only the CPU 81 or the ASIC 85 may perform all processing or a combination of the CPU 81 and the ASIC 85 may perform all processing. Alternatively, the controller 80 may include a single CPU 81 that may perform all processing or include a plurality of CPUs 81 that may share all processing. Alternatively, the controller 80 may include a single ASIC 85 that may perform all processing or include a plurality of ASICs 85 that may share all processing.

Control During Image Recording

Hereinafter, a description will be provided on a process of recording an image on a recording sheet P in the printer 1.

Figure 7:
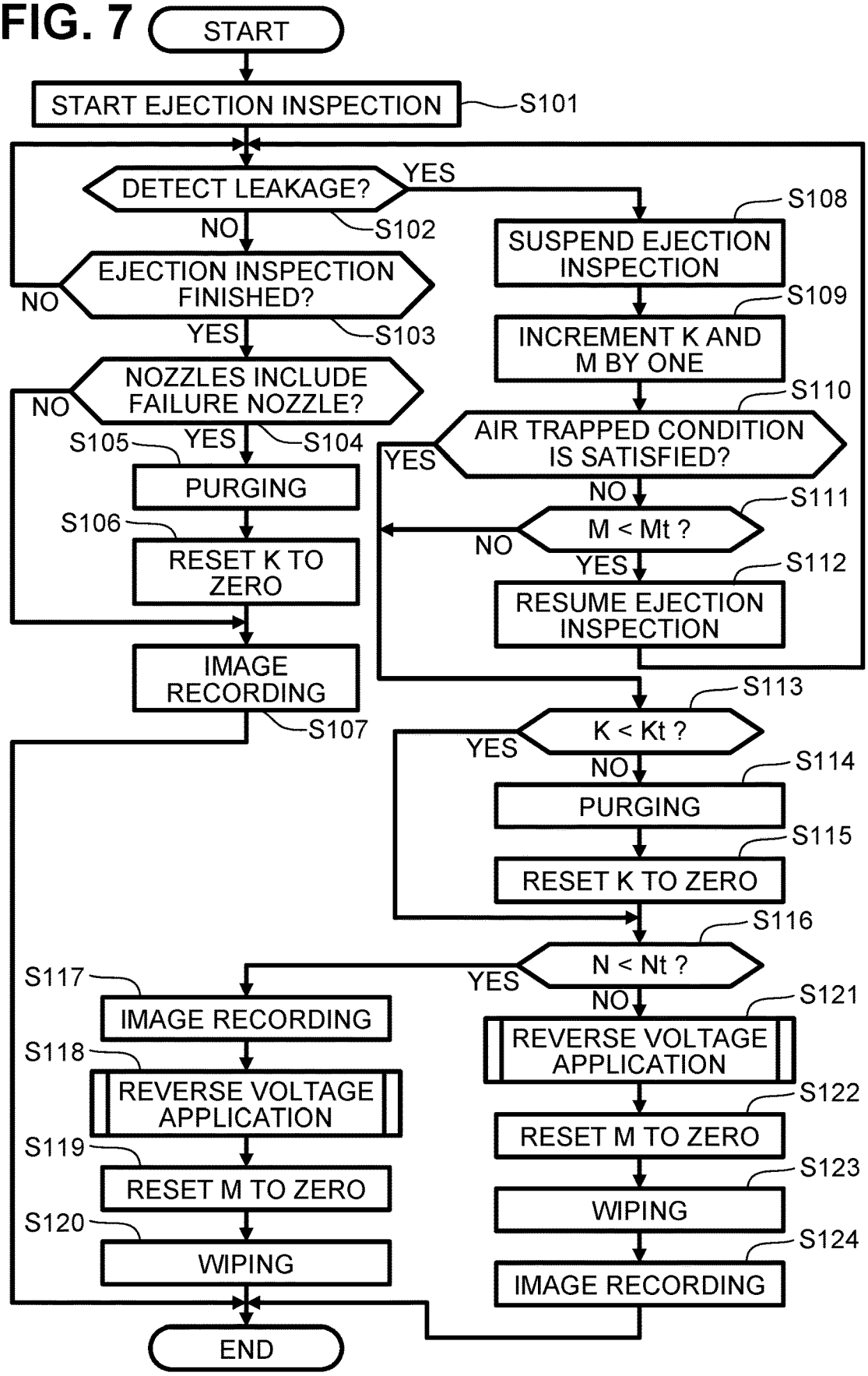
FIG. 7 is a flowchart in image recording.

In the printer 1, in response to receiving a recording instruction to instruct the printer 1 to perform image recording, the controller 80 executes processing in accordance with the flowchart of FIG. 7.

More specifically, in response to receiving the recording instruction, the controller 80 starts ejection inspection (S101). In the ejection inspection, the controller 80 performs the following to determine whether the nozzles 10 include a failure nozzle. The controller 80 controls the carriage motor 86 and the cap up-and-down mechanism 88 to set the nozzles 10 in the capped state, and controls the high-voltage power supply circuit 92 to apply an inspection voltage between the detection electrode 91 and the inkjet head 4. In this state, the controller 80 controls the driver IC 89 to drive the inkjet head 4 to eject ink from each nozzle 10 in sequence, and determines whether a nozzle 10 is a failure nozzle based on a signal outputted from the output 94*b*.

If the controller 80 does not detect that a leakage occurs based on a signal from the output 94*a* (S102: NO) and the ejection inspection is not finished (S103: NO), the controller 80 continues the ejection inspection. If the controller 80 does not detect that a leakage occurs (S102: NO) and the ejection inspection has been finished (S103: YES), the controller 80 determines whether the nozzles 10 of the inkjet head 4 include a failure nozzle (S104).

If the controller 80 determines that the nozzles 10 do not include a failure nozzle (S104: NO), the process proceeds to S107. If the controller 80 determines that the nozzles 10 include a failure nozzle (S104: YES), the controller 80 executes purging (S105). In purging in S105, the controller 80 controls the suction pump 72 to perform the suction purge described above. After purging in S105, the controller 80 resets a variable K to zero (S106) and proceeds to image recording in S107. The variable K corresponds to the number of occurrences of a leakage that the controller 80 has determined since previously performed purging. The variable K is set to zero at the time of manufacture of the printer 1.

In image recording in S107, the controller 80 controls the conveyance motor 87 and a sheet feeder to convey a recording sheet P to the feeder and the conveyance rollers 6 and 7. The controller 80 controls the carriage motor 86 to move the carriage 2 in the scanning direction, and controls the driver IC 89 to cause the inkjet head 4 to eject ink from the nozzles 10, and controls the conveyance motor 87 to cause the conveyance rollers 6 and 7 to convey a recording sheet P for a predetermined distance. The controller 80 controls them repeatedly to record an image on the recording sheet P. After finishing recording the image on the recording sheet P, the controller 80 controls the conveyance motor 87 to cause the conveyance rollers 6 and 7 to discharge the recording sheet P. In a case where a recording instruction indicates image recording on two or more recording sheets P, the above operations are repeated until all recording sheets P have been printed.

In contrast, if the controller 80 detects that a leakage occurs before the ejection inspection is finished (S102: YES), the controller 80 suspends the ejection inspection (S108). At this time, the controller 80 controls the high-voltage power supply circuit 92 to terminate application of the inspection voltage. Subsequently, the controller 80 increments values of the variables K and M by one (109). The variable M corresponds to the number of occurrences of a leakage that the controller 80 has determined since a previous reverse voltage application, which will be described later. The variable M is set to zero at the time of manufacture of the printer 1.

The controller 80 then determines whether an air trapped condition is satisfied (S110). The air trapped condition indicates that there is a high possibility that the inkjet head 4 has air trapped in its channels. The controller 80 determines that the air trapped condition is satisfied upon satisfaction of one of the following conditions that: for example, a purging instruction signal to perform suction purge has been input in response to the user operation of the operation device 70; the printer 1 is not turned on for more than a certain time period; it is at a time immediately after the ink cartridges 14 are attached to the cartridge holder 13; and the temperature is higher than a predetermined temperature.

In the above example, the purging instruction signal inputted to the controller 80 by a user operation on the operation device 70, a power-on signal inputted to the controller 80 when the printer 1 is turned on after a certain length of time, a signal inputted to the controller 80 from the cartridge sensor 16 when an ink cartridge 15 is attached to the cartridge holder 13, and a signal inputted to the controller 80 from the temperature sensor 68 are an example of items of information related to whether air is trapped in a liquid channel.

Where the air trapped condition is not satisfied (S110: NO), the controller 80 determines whether the variable M is below a predetermined value Mt. In response to determining that the variable M is below the predetermined value Mt (S111: YES), the controller 80 resumes the ejection inspection suspended in S108 (S112), and returns to S102. In this case, the ejection inspection is continued.

Where the air trapped condition is satisfied (S110: YES), the controller 80 proceeds to S113. Where the air trapped condition is not satisfied (S110: NO) and the variable M is not below the predetermine value Mt, that is, greater than or equal to the predetermined value Mt (S111: NO), the controller 80 proceeds to S113. In these cases, the ejection inspection suspended in S108 is never resumed. The ejection inspection is canceled.

In S113, the controller 80 determines whether the variable K is below a predetermined value Kt. Where the variable K is below the predetermined value Kt (S113: YES), the controller 80 proceeds to S116. Where the variable K is not below the predetermine value Kt, that is, greater than or equal to the predetermined value Kt (S113: NO), the controller 80 performs purging similar to that in S105 (S114), resets the variable K to zero (S115), and proceeds to S116.

In S116, the controller 80 determines whether the number N of recording sheets P included in the recording instruction is below a predetermined number Nt. In response to determining that the number N of recording sheets P is below the predetermined number Nt (S116: YES), the controller 80 performs image recording similar to that in S107 (S117). Subsequently, the controller 80 performs the reverse voltage application (S118), resets the variable M to 0 (S119), and then performs wiping (S120). The reverse voltage application to be performed in S118 will be described later in detail. In S120, the controller 80 performs wiping described above by controlling the carriage motor 86 and the wiper up-and-down mechanism 59.

In contrast, in response to determining that the number N of recording sheets P included in the recording instruction is not below the predetermined number Nt, that is, greater than or equal to the predetermined number Nt (S116: NO), the controller 80 performs reverse voltage application similar to that in S118 (S121), resets the variable M to zero (S122), and performs wiping similar to that in S120 (S123). Subsequently, the controller 80 performs image recording similar to that in S117 (S124).

Reverse Voltage Application

Figure 8:
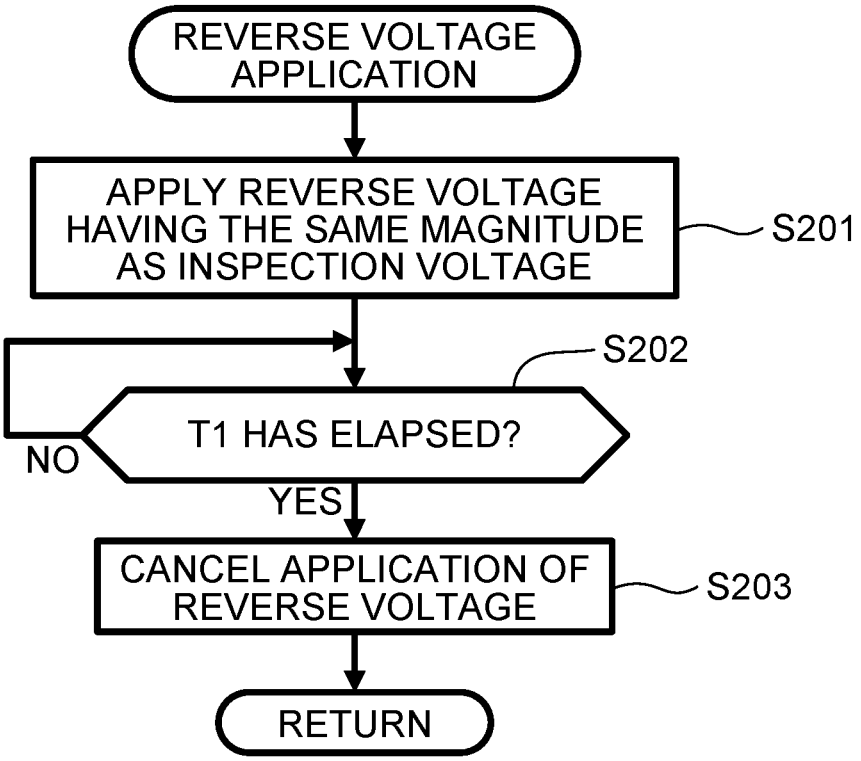
FIG. 8 is a flowchart of a reverse voltage application in FIG. 7.

Next, the reverse voltage application in S118 and S121 will be described. In the reverse voltage application in S118 and S121, the controller 80 performs processing in accordance with the flowchart of FIG. 8. More specifically, the controller 80 controls the high-voltage power supply circuit 92 to apply a reverse voltage that is the same in magnitude as the inspection voltage but opposite in polarity between the detection electrode 91 and the inkjet head 4 (S201). The controller 80 maintains the application of the reverse voltage unless a time T1 has elapsed from the start of the application of the reverse voltage (S202: NO). Where the time T1 has elapsed from the start of the application of the reverse voltage (S202: YES), the controller 80 controls the high-voltage power supply circuit 92 to cancel the application of the reverse voltage (S203). The time T1 refers to a time during which a leakage current greater than the predetermined value flows from the time at which the controller 80 detects that a leakage occurs in S102 to the time at which the controller 80 suspends ejection inspection in S108 and cancels the application of the inspection voltage. This time is measured by a timer built in the controller 80.

Effects

In response to the occurrence of a leakage, ink is electrolyzed. This may cause hydrogen gas in the individual channels 41, thereby increasing ink pressure. The electrolysis may change ink properties. The longer the time for which ink is electrolyzed, the more likely the above factors are to cause problems such as separation between the plate 31 and the plate 32. Thus, ink may be electrolyzed in as short time as possible in response to the occurrence of a leakage.

Furthermore, the inkjet head 4 has capacitance. Electric charge accumulates in the inkjet head 4 on the occurrence of a leakage, and electrolysis of ink proceeds after electric charge has accumulated throughout the inkjet head 4. The electric charge remaining in the inkjet head 4 after the leakage may accelerate the electrolysis of ink immediately after the next leakage occurs. As a result, ink may be electrolyzed in a longer time.

In this embodiment, however, if an occurrence of a leakage between the detection electrode 91 and the inkjet head 4 is detected during ejection inspection, the ejection inspection is suspended, and a reverse voltage opposite in polarity to the inspection voltage is applied therebetween. The electric charge accumulated in the inkjet head 4 can be thus discharged therefrom in response to the occurrence of a leakage.

The ejection inspection may be performed by bringing the nozzles 10 as close to the detection electrode 91 as possible to increase change in potential of the detection electrode 91 at which ink is ejected from the nozzles 10. However, a leakage is more likely to occur as the nozzles 10 are brought closer to the detection electrode 91. In this embodiment, in response to the occurrence of a leakage, the electric charge accumulated in the inkjet head 4 can be discharged through the application of the reverse voltage. This enables the ejection inspection under a state that the nozzles 10 in the capped state are brought as close to the detection electrode 91 as possible.

In this embodiment, a reverse voltage having the same magnitude as the inspection voltage is applied for the same length of time as the time T1 during which a leakage current greater than the predetermined value flows. Flowing of a leakage current can discharge the electric charge from the inkjet head 4, thus reducing excessive application of the reverse voltage that may cause accumulation of electric charge with the opposite polarity in the inkjet head 4.

When a leakage occurs, a leakage current flows to electrolyze ink. Deposits of ink electrolyzed may accumulate around the nozzles 10 of the nozzle surface 4*a*. In this state, the nozzles 10 may not eject ink normally. In this embodiment, wiping is performed after the reverse voltage application to remove deposits from the nozzle surface 4*a*.

In this embodiment, in a case where the number of recording sheets P to be recorded at one time is small, the reverse voltage application takes more time than recording on the recording sheets P. Therefore, unlike this embodiment, if the reverse voltage is applied before recording on the recording sheets P, the user may easily recognize a time lag between the recording instruction and the completion of recording on the recording sheets P. In addition, the time required for recording on the recoding sheets P is shorter than the time required for the reverse voltage application. Thus, the time for which the inkjet head 4 is maintained with the electric charge accumulated is short even if the reverse voltage is applied after the completion of recording on the recording sheets P. In this embodiment, in a case where recording is performed for the number of the recording sheets P smaller than the predetermined number Nt, the reverse voltage is applied after the completion of recording on the recording sheets P.

In contrast, in a case where the number of recording sheets P to be recorded at one time is large, the reverse voltage application takes less time than recording on the recording sheets P. Therefore, when the reverse voltage is applied before recording on the recording sheets P, the user may hardly recognize a time lag between the recording instruction and the completion of recording on the recording sheets P. In addition, in a case where the number of recording sheets P to be recorded at one time is large, recording on all recording sheets P takes a long time. Thus, unlike this embodiment, if the reverse voltage is applied after the completion of recording on the recoding sheets, the inkjet head 4 will be remained with the electric charge accumulated for a long time. In this embodiment, in a case where recording is performed for the number of the recording sheets P larger than the predetermined number Nt, recording on the recording sheets P is performed after the completion of the reverse voltage application.

In this embodiment, deposits of ink to be produced through electrolysis in every occurrence of a leakage may accumulate in the nozzles 10. More deposits of ink in the nozzles 10 may hinder the nozzles 10 to eject ink normally. Therefore, in this embodiment, suction purge is performed when the variable K corresponding to the number of occurrences of a leakage that the controller 80 has determined since previously performed suction purge is greater than or equal to the predetermined value Kt. This enables discharging of the deposits having accumulated in the nozzles 10 before the deposit accumulation reaches a maximum amount.

In a case where no air is trapped in the individual channels 41, a leakage current evenly flows through ink in the channels of the inkjet head 4 when a leakage has occurred. Thus, the value of the leakage current flowing through each part of the respective individual channels 41 is small and the speed at which the electrolysis of ink progresses is slow. In contrast, in a case where air is trapped in the individual channels 41, ink in the respective individual channels 41 is partitioned by air. In this case, when a leakage occurs, a leakage current flows locally in ink that is partitioned by air and closer to the nozzles 10 in the individual channels 41. As a result, the value of the leakage current becomes large, and the speed at which the electrolysis of ink progresses becomes fast.

In this embodiment, in a case where the air trapped condition is satisfied, the ejection inspection is immediately canceled and a reverse voltage is applied. In contrast, in a case where the air trapped condition is not satisfied, the ejection inspection is resumed when the variable M, which corresponds to the number of occurrences of a leakage has occurred since the previous reverse voltage application, is below the predetermined value Mt. When the variable M is greater than or equal to the predetermined value Mt, the ejection inspection is canceled and a reverse voltage is applied.

Modifications

While the disclosure has been described in detail with reference to the specific embodiment thereof, this is merely an example, and various changes, arrangements and modifications may be applied therein without departing from the spirit and scope of the disclosure.

In the above embodiment, in a case where the air trapped condition is satisfied, the ejection inspection is canceled (and never resumed) and the reverse voltage application is performed. In contrast, in a case where the air trapped condition is not satisfied, the ejection inspection is canceled and the reverse voltage application is performed when the variable M, which corresponds to the number of occurrences of a leakage that the controller 80 has determined since the previous reverse voltage application, is greater than or equal to the predetermined value Mt.

In some embodiments, regardless of whether the air trapped condition is satisfied, the ejection inspection may be immediately canceled in response to the occurrence of a leakage, to perform the reverse voltage application. Alternatively, regardless of whether the air trapped condition is satisfied, the ejection inspection may be resumed while the variable M is below the predetermined value Mt, and be canceled immediately when the variable M is greater than or equal to the predetermined value Mt, to perform the reverse voltage application.

In the above embodiment, suction purge is performed when the variable K, which corresponds to the number of occurrences of a leakage that the controller 80 has determined since the previous suction purge, is greater than or equal to the predetermined value Kt. However, suction purge may be performed regardless of the number of occurrences of a leakage that the controller 80 has determined since the previous suction purge.

In the above embodiment, in a case where a leakage has occurred, the reverse voltage application is performed after image recording when the recording instruction indicates the number N of recording sheets P is below the predetermined number Nt, and the reverse voltage application is performed before image recording when the recording instruction indicates the number N is larger than the predetermined number Nt.

However, the reverse voltage application may be performed after image recording, regardless of the number N of recording sheets P. Alternatively, the reverse voltage application may be performed before image recording, regardless of the number N of recording sheets P.

In the above embodiment, wiping is performed after the reverse voltage application. However, wiping may not be performed after the reverse voltage application.

In the above embodiment, the reverse voltage application is performed by applying a reverse voltage having the same magnitude as the inspection voltage and the opposite polarity thereto between the inkjet head 4 and the detection electrode 91 for the same length of time as the time T1 during which a leakage current greater than the predetermined value flows. However, the reverse voltage application is not limited to this.

Figure 9A:
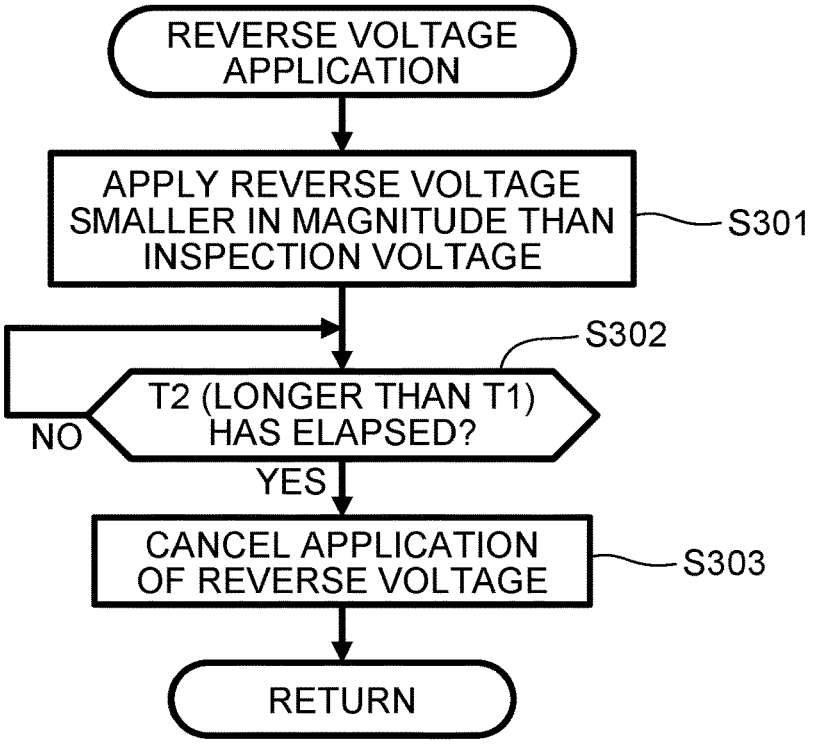
FIG. 9A is a flowchart of a reverse voltage application according to a first modification, corresponding to FIG. 8.

In a first modification, the controller 80 performs the reverse voltage application in accordance with the flowchart of FIG. 9A. More specifically, the controller 80 controls the high-voltage power supply circuit 92 to apply a reverse voltage that is smaller in magnitude than the inspection voltage and is opposite in polarity between the detection electrode 91 and the inkjet head 4 (S301). The controller 80 maintains the application of the reverse voltage unless a time T2, which is longer in length than the time T1, has elapsed from the start of the application of the reverse voltage (S302: NO). Where the time T2 has elapsed from the start of the application of the reverse voltage (S302: YES), the controller 80 controls the high-voltage power supply circuit 92 to cancel the application of the reverse voltage (S303).

Figure 9B:
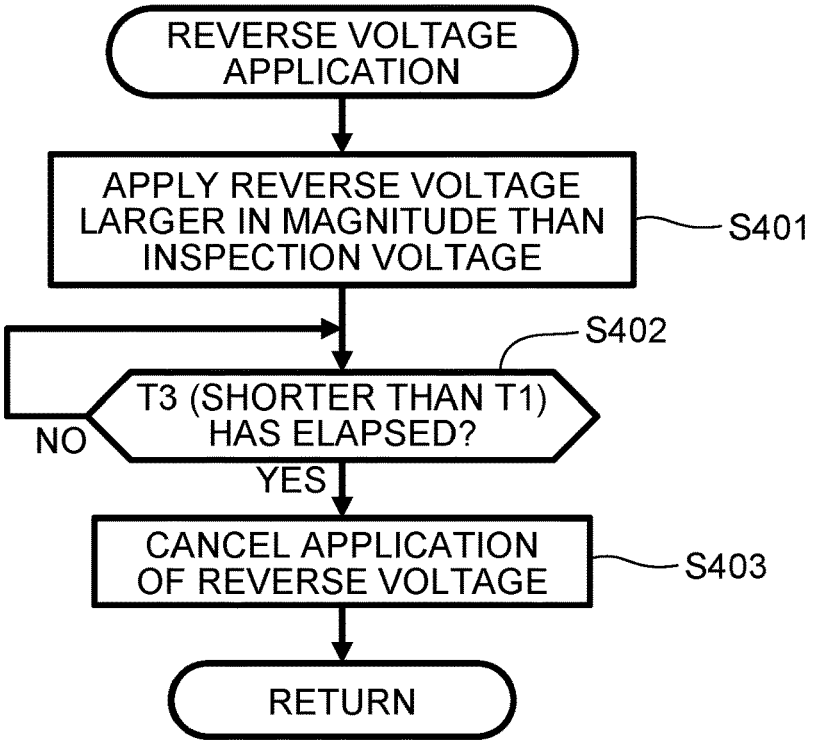
FIG. 9B is a flowchart of a reverse voltage application according to a second modification, corresponding to FIG. 8.

In a second modification, the controller 80 performs the reverse voltage application in accordance with the flowchart of FIG. 9B. More specifically, the controller 80 controls the high-voltage power supply circuit 92 to apply a reverse voltage that is larger in magnitude than the inspection voltage and is opposite in polarity between the detection electrode 91 and the inkjet head 4 (S401). The controller 80 maintains the application of the reverse voltage unless a time T3, which is shorter in length than the time T1, has elapsed from the start of the application of the reverse voltage (S402: NO). Where the time T3 has elapsed from the start of the application of the reverse voltage (S402: YES), the controller 80 controls the high-voltage power supply circuit 92 to cancel the application of the reverse voltage (S403).

Even in the first and second modifications, flowing of a leakage current can discharge the electric charge from the inkjet head 4, thus reducing excessive application of the reverse voltage that may cause accumulation of electric discharge with the opposite polarity in the inkjet head 4.

The above embodiment, the first modification, and the second modification show, but are not limited to, the application of the reverse voltage for a time determined based on the time T1 measured by the timer. The time from when a leakage is detected in S102 and the ejection inspection is suspended in S108 to when the application of the inspection voltage is canceled falls normally within a certain period of time. For example, information on a particular time falling within the certain period of time may be stored in the flash memory 84, and the time for applying the reverse voltage may be determined based on the stored information on the particular time.

In the reverse voltage application, the magnitude of the reverse voltage to be applied between the detection electrode 91 and the inkjet head 4 and the time for applying the reverse voltage are not limited to those described in the above embodiment, the first modification, and the second modification.

In the above embodiment, ink is discharged from the nozzles 10 of the inkjet head 4 by suction purge. However, the discharging operation is not limited to the suction purge. Instead of the suction purge, a booster pump, for example, may be used. The booster pump may be disposed in portions of the tubes 15 connecting the subtank 3 and the ink cartridges 14. Alternatively, the printer may include the booster pump to be connected to an ink cartridge. The booster pump may be driven in a state where the nozzles 10 are covered by the cap 71 to increase the pressure of ink in the inkjet head 4, thereby causing the inkjet head 4 to discharge ink from the nozzles 10 toward the cap 71. The so-called pressurized purging may be performed. In this case, the booster pump is an example of discharging means.

Alternatively, both of suction by the suction pump 72 and pressurization by the booster pump may be performed. In this case, a combination of the suction pump 72, the waste liquid tank 73, and the booster pump is an example of discharging means.

Alternatively, flushing may be performed by driving the inkjet head 4 to discharge ink from the nozzles 10. In this case, the inkjet head 4 also serves as discharging means.

In the above embodiment, the ejection inspection is performed to determine whether the nozzles 10 include a failure nozzle that does not eject ink. In a case where ink is ejected from a nozzle 10 in an unintended direction, the time for which the ejected ink reaches the detection electrode 91 is long and the potential of the detection electrode 91 changes gently compared to a case where ink is ejected from a nozzle in an intended direction. From this reason, the ejection inspection may be performed to determine whether the nozzles 10 include a failure nozzle that ejects ink in an unintended direction, based on a period of time from when the inkjet head 4 is driven to when the potential outputted from the output 94*b* exceeds the threshold value Vt.

In the above embodiment, the ejection inspection is performed with the nozzles 10 in the capped state. However, the ejection inspection may be performed with the nozzle surface 4*a* slightly spaced from the lip portion 71*a* of the cap 71.

In the above embodiment, the controller 80 determines whether a leakage has occurred based on a signal from the output 94*a* of the signal output circuit 94 connected to the detection electrode 91. However, the controller 80 may determine whether a leakage has occurred based on a signal outputted from, for example, a circuit connected to the conductive portion of the inkjet head 4. In this case, the signal may be responsive to change in potential of the conductive portion.

The disclosure has been applied to a printer including a serial head that moves in the scanning direction together with a carriage. However, the disclosure may also be applied to a printer including, for example, a line head extending over the entire length of a recording sheet P in the scanning direction.

The disclosure has been applied to a printer that ejects ink from nozzles to record an image on a recording sheet P. However, the disclosure may also be applied to another printer that may record an image on a recording medium other than a recording sheet. Examples of the recording media include a T-shirt, a sheet for outdoor advertisement, a casing of a mobile terminal such as a smartphone, a cardboard, and a resin member. Further, the disclosure may also be applied to a liquid ejection apparatus that may eject liquid other than ink such as liquid resin or liquid metal.

What is claimed is:

1. A liquid ejection apparatus comprising:

a liquid ejection head having an array of nozzles, the liquid ejection head being configured to eject liquid from each of the nozzles;

a cap configured to cover the nozzles;

an electrode accommodated in the cap;

a voltage applying circuit configured to apply a voltage between the electrode and the liquid ejection head;

a signal output circuit connected to the electrode; and a controller configured to, in response to receiving a recording instruction to instruct the liquid ejection apparatus to perform image recording on a recording medium, perform ejection inspection to determine whether liquid is ejected from each nozzle toward the electrode based on a signal outputted from the signal output circuit, wherein, to perform the ejection inspection, the controller is configured to cause the liquid ejection head and the cap to face each other, control the voltage applying circuit to apply an inspection voltage between the electrode and the liquid ejection head with the liquid ejection head and the cap facing each other, and drive the liquid ejection head to eject liquid from a nozzle of the nozzles toward the electrode, wherein, during the ejection inspection, the controller is configured to detect whether a leakage current greater than a predetermined value flows between the electrode and the liquid ejection head based on a signal from the signal output circuit, wherein, in response to detecting that a leakage current greater than the predetermined value flows between the electrode and the liquid ejection head, the controller is configured to cancel the ejection inspection and control the voltage applying circuit to apply a reverse voltage opposite in polarity to the inspection voltage between the electrode and the liquid ejection head.

2. The liquid ejection apparatus according to claim 1, wherein, in response to detecting that a leakage current greater than the predetermined value flows between the electrode and the liquid ejection head during the ejection inspection, the controller is configured to control the voltage applying circuit to apply a reverse voltage that is the same in magnitude as the inspection voltage and is opposite in polarity between the electrode and the liquid ejection head for the same length of time as that of the inspection voltage.

3. The liquid ejection apparatus according to claim 1, wherein, in response to detecting that a leakage current greater than the predetermined value flows between the electrode and the liquid ejection head during the ejection inspection, the controller is configured to control the voltage applying circuit to apply a reverse voltage that is smaller in magnitude than the inspection voltage and is opposite in polarity between the electrode and the liquid ejection head for a length of time longer than that of the inspection voltage.

4. The liquid ejection apparatus according to claim 1, wherein, in response to detecting that a leakage current greater than the predetermined value flows between the electrode and the liquid ejection head during the ejection inspection, the controller is configured to control the voltage applying circuit to apply a reverse voltage that is larger in magnitude than the inspection voltage and is opposite in polarity between the electrode and the liquid ejection head for a length of time shorter than that of the inspection voltage.

5. The liquid ejection apparatus according to claim 1, further comprising a wiper, wherein the liquid ejection head has a nozzle surface defining the nozzles, and wherein the controller is configured to control the wiper to wipe liquid adhering to the nozzle surface after application of the reverse voltage.

6. The liquid ejection apparatus according to claim 1, wherein, in response to receiving a recording instruction to instruct the liquid ejection apparatus to perform image recording on a recording medium, the controller is configured to perform the ejection inspection and then perform image recording by controlling the liquid ejection head to eject liquid from the nozzles to a recording medium, and wherein, in response to detecting that a leakage current greater than the predetermined value flows between the electrode and the liquid ejection head during the ejection inspection, the controller is configured to cancel the ejection inspection, perform image recording by controlling the liquid ejection head to eject liquid from the nozzles to a recording medium, and then control the voltage applying circuit to apply the reverse voltage between electrode and the liquid ejection head.

7. The liquid ejection apparatus according to claim 6, wherein, in response to detecting that the leakage current greater than the predetermined value flows between the electrode and the liquid ejection head during the ejection inspection, the controller is configured to suspend the ejection inspection and determine whether the number of recording media included in the recording instruction is below a predetermined number, wherein, in response to determining that the number of recording media included in the recording instruction is below the predetermined number, the controller is configured to perform image recording on all the recording media by controlling the liquid ejection head to eject liquid from the nozzles to each of the recording media, and then control the voltage applying circuit to apply the reverse voltage between electrode and the liquid ejection head, and wherein, in response to determining that the number of recording media included in the recording instruction is greater than or equal to the predetermined number, the controller is configured to cancel the ejection inspection and control the voltage applying circuit to apply the reverse voltage between the electrode and the liquid ejection head, and then perform image recording on all the recording media by controlling the liquid ejection head to eject liquid from the nozzles to each of the recording media.

8. The liquid ejection apparatus according to claim 1, further comprising discharging means for performing a discharging operation in which liquid in the liquid ejection head is discharged from the nozzles, wherein, in response to determining that the number of occurrences that the leakage current greater than the predetermined value flows the controller has detected since a discharging operation previously performed is greater than or equal to a predetermined value, the controller is configured to cause the discharging means to perform the discharging operation.

9. The liquid ejection apparatus according to claim 1, wherein the liquid ejection head has a liquid channel including the nozzles, wherein, in response to detecting that a leakage current greater than the predetermined value flows between the electrode and the liquid ejection head during the ejection inspection, the controller is configured to receive information related to whether air is trapped in the liquid channel and determines whether air is trapped in the liquid channel based on the received information, wherein, in response to determining that air is trapped in the liquid channel, the controller is configured to cancel the ejection inspection and control the voltage applying circuit to apply the reverse voltage between the electrode and the liquid ejection head, wherein, in response to determining that no air is trapped in the liquid channel, the controller is configured to determine whether the number of occurrences that the leakage current greater than the predetermined value flows the controller has detected since a previous application of the reverse voltage between the electrode and the liquid ejection head is below a predetermined value, wherein, in response to determining that the number of occurrences is below the predetermined value, resume the ejection inspection, the controller is configured to resume the ejection inspection, and wherein, in response to determining that the number of occurrences is above the predetermined value, cancel the ejection inspection and control the voltage applying circuit to apply the reverse voltage between the electrode and the liquid ejection head.

* * * * *